US010512316B2

(12) United States Patent
Haarburger

(10) Patent No.: US 10,512,316 B2
(45) Date of Patent: Dec. 24, 2019

(54) SYSTEMS AND METHODS FOR A HOLDER AND TOOL DEVICE

(71) Applicant: Nite Ize, Inc., Boulder, CO (US)

(72) Inventor: Daniel Haarburger, Boulder, CO (US)

(73) Assignee: Nite Ize, Inc., Boulder, CO (US)

( * ) Notice: Subject to any disclaimer, the term of this patent is extended or adjusted under 35 U.S.C. 154(b) by 82 days.

(21) Appl. No.: 15/230,105

(22) Filed: Aug. 5, 2016

(65) Prior Publication Data

US 2017/0035169 A1 Feb. 9, 2017

Related U.S. Application Data

(60) Provisional application No. 62/201,471, filed on Aug. 5, 2015.

(51) Int. Cl.

| | |
|---|---|
| ***A45C 15/00*** | (2006.01) |
| ***A45C 1/06*** | (2006.01) |
| *B67B 7/16* | (2006.01) |

(52) U.S. Cl.

CPC ..... *A45C 1/06* (2013.01); *A45C 15/00* (2013.01); *A45C 2001/062* (2013.01); *A45C 2001/065* (2013.01); *A45C 2001/067* (2013.01); *B67B 7/16* (2013.01)

(58) Field of Classification Search

CPC ..... A45C 1/06; A45C 15/00; A45C 2001/062; A45C 2001/065; A45C 2001/067; B67B 7/44

See application file for complete search history.

(56) References Cited

U.S. PATENT DOCUMENTS

| | | | | |
|---|---|---|---|---|
| 1,157,733 | A * | 10/1915 | Stevenson | B65D 5/6697 206/805 |
| 1,741,270 | A * | 12/1929 | Altman | A45C 13/18 150/106 |
| D116,179 | S | 6/1939 | Yates | |
| 2,421,487 | A * | 6/1947 | Dyck | B42D 5/001 281/50 |
| D197,915 | S * | 4/1964 | Ayars | 7/164 |
| 3,461,469 | A | 8/1969 | Morrison | |
| 3,970,129 | A | 7/1976 | Tepfer | |
| 4,073,205 | A | 2/1978 | Silliman | |
| D257,383 | S | 10/1980 | Davenport | |
| D266,479 | S | 10/1982 | Hayakawa | |
| D302,514 | S | 8/1989 | Gates | |

(Continued)

FOREIGN PATENT DOCUMENTS

| | | |
|---|---|---|
| CN | 202174590 U | 3/2012 |
| CN | 203897513 U | 10/2014 |

OTHER PUBLICATIONS

Lever, Toolcard Pro with Clip—Silver, from Google search for "multi tool wallet card" before Aug. 4, 2015, https://levergear.com/product/bead-blast/?gclid=CjwKCAjw75HWBRAwEiw-AdzefxFW9CBp-QTP0uCH6Ot2kPE0VIwXkZy1Juy4emML8b6qRp5BmvFfTmRoCxpUQAvD_BwE.*

(Continued)

*Primary Examiner* — Tri M Mai

(74) *Attorney, Agent, or Firm* — Haynes and Boone, LLP

(57) ABSTRACT

A tool and wallet system includes a planar body portion, the planar body portion approximately the size of a standard credit card, and a strap, the strap wrapped around the planar body portion, the strap taut to the planar body portion due to elasticity in the strap. The tool and wallet system includes numerous tools.

22 Claims, 4 Drawing Sheets

(56) References Cited

U.S. PATENT DOCUMENTS

| | | | | |
|---|---|---|---|---|
| D345,860 | S | 4/1994 | Lacy | |
| D356,240 | S * | 3/1995 | Meldahl | D8/105 |
| D377,808 | S | 2/1997 | Coe | |
| D399,405 | S | 10/1998 | Savoia | |
| 5,944,080 | A | 8/1999 | Podwika | |
| D416,581 | S | 11/1999 | Cheng | |
| D431,105 | S | 9/2000 | Ling | |
| 6,230,878 | B1 * | 5/2001 | Lehr | A45C 1/06 206/37 |
| D449,211 | S | 10/2001 | Jean et al. | |
| D462,000 | S * | 8/2002 | Hightower | D8/40 |
| 6,460,698 | B1 | 10/2002 | Wang | |
| D517,390 | S | 3/2006 | Cheng et al. | |
| D547,062 | S | 7/2007 | Chang | |
| D584,049 | S | 1/2009 | Uzelac | |
| 7,510,683 | B2 | 3/2009 | Itoh | |
| D611,249 | S | 3/2010 | Uzelac | |
| D628,796 | S | 12/2010 | Uzelac | |
| D657,557 | S | 4/2012 | Deinert | |
| D707,091 | S | 6/2014 | Barr | |
| D710,179 | S | 8/2014 | Thomas et al. | |
| D716,044 | S * | 10/2014 | Wilk | D3/247 |
| D724,841 | S | 3/2015 | Schneider et al. | |
| D737,173 | S * | 8/2015 | Kelleghan | D11/201 |
| D739,713 | S * | 9/2015 | Kelleghan | D8/356 |
| 9,125,464 | B2 | 9/2015 | Minn et al. | |
| D751,877 | S * | 3/2016 | Shlaferman | D8/19 |
| 9,302,383 | B2 * | 4/2016 | Barr | B25F 1/00 |
| 9,314,074 | B2 | 4/2016 | Johnson et al. | |
| D756,178 | S * | 5/2016 | Kelleghan | D2/639 |
| D799,301 | S | 10/2017 | Cetera et al. | |
| 2008/0236712 | A1 | 10/2008 | Chisolm | |
| 2010/0065171 | A1 | 3/2010 | Uzelac | |
| 2013/0256348 | A1 | 10/2013 | Seuk | |
| 2013/0276943 | A1 | 10/2013 | Minn et al. | |
| 2014/0143958 | A1 | 5/2014 | Barr | |
| 2015/0083289 | A1 | 3/2015 | Johnson et al. | |
| 2016/0324286 | A1 | 11/2016 | Fathollahi et al. | |
| 2017/0035169 | A1 | 2/2017 | Haarburger | |

OTHER PUBLICATIONS

Google Search, term "x-shaped rubber bands", before Jul. 5, 2015.*
The Multi, Kickstarter, dated Mar. 19, 2013.*
International Search Report issued in related PCT App. No. PCT/US2016/045866 dated Oct. 13, 2016 (2 pages).
International Written issued in related PCT App. No. PCT/US2016/045866 dated Oct. 13, 2016 (7 pages).
Chinese Office Action dated Mar. 29, 2019 (English translation).

* cited by examiner

SYSTEMS AND METHODS FOR A HOLDER AND TOOL DEVICE

CROSS-REFERENCE TO RELATED APPLICATIONS

This application claims the benefit of U.S. Provisional Application No. 62/201,471, filed on Aug. 5, 2015, which is incorporated herein by reference in its entirety.

BACKGROUND

Most individuals carry a wallet, money clip, or other credit card and money holding device daily. It is desirable to have a lightweight, easy-to-use device to organize such possessions in one's pocket. Additionally, having compact and easily transported tools that are pocket sized and available to a user is desirable.

BRIEF SUMMARY

In one embodiment, a tool and wallet system includes a planar body portion, the planar body portion approximately the size of a standard credit card and a strap, the strap wrapped around the planar body portion, the strap taut to the planar body portion due to elasticity in the strap. Optionally, the strap includes two circular strap portions connected via a connecting strap portion, the two circular strap portions encircling the planar body portion. In one configuration, the planar body portion has first, second, third, and fourth grooves; said first, second, third, and fourth grooves located on a first edge and a second edge of the planar body portion, the planar body portion being rectangular in shape, and the first and second edges located on opposing sides of the planar body portion; the first and second grooves located on the first edge and the third and fourth grooves located on the second edge; the first, second, third, and fourth grooves sized to receive the two circular strap portions and configured such that a first one of the two circular straps is located in the first and third grooves and a second one of the two circular straps is located in the second and fourth grooves. Alternatively, the planar body portion includes a first aperture, the first aperture includes protrusions for prying open a cap on a bottle. Optionally, the planar body portion includes a second aperture for receiving bolt-shaped connectors. In one configuration, the second aperture for receiving bolt-shaped connectors has a stepped shape; and the second aperture has three portions, each having a different width, each different width corresponding to a standard nut width. In one configuration, the planar body portion is approximately rectangular in shape, and a first corner of the planar body portion includes a flathead projection configured to function as a flathead screw driver. Optionally, a second corner of the planar body portion includes a cruciform projection and is configured to function as a cruciform screw driver. Alternatively, the cruciform projection is flat and in line with the planar body portion. In one alternative, a first edge of the planar body portion includes a scraping portion, the scraping portion being a portion of the body that is angled towards the edge, resulting in a thinner, beveled edge. In another alternative, a second edge of the planar body includes a marked measuring portion, the second edge being parallel to the first edge.

In one embodiment, a tool and wallet system includes a planar body portion, the planar body portion approximately the size of a standard credit card, the planar body portion having an approximately rectangular shape and a strap, the strap wrapped around the planar body portion, the strap taught to the planar body portion due to elasticity in the strap, and the strap and planar body portion configured to hold paper money and credit cards. Optionally, the strap includes two circular strap portions connected via a connecting strap portion, the two circular strap portions encircling the planar body portion. Alternatively, the planar body portion has first, second, third, and fourth grooves; said first, second, third, and fourth grooves located on a first edge and a second edge of the planar body portion, the planar body portion being rectangular in shape, and the first and second edge located on opposing sides of the planar body portion; the first and second grooves located on the first edge and the third and fourth grooves located on the second edge; the first, second, third, and fourth grooves sized to receive the two circular strap portions and configured such that a first one of the two circular straps is located in the first and third grooves, and a second one of the two circular straps is located in the second and fourth grooves. In one alternative, the planar body portion includes a first aperture, the first aperture includes protrusions for prying open a cap on a bottle; the planar body portion includes a second aperture for receiving bolt-shaped connectors, and the second aperture for receiving bolt-shaped connectors has a stepped shape, and the second aperture has three portions, each having a different width, each different width corresponding to a standard nut width. In another alternative, the planar body portion includes numerous cutouts that reduce the weight of the planar body portion. Optionally, a first corner of the planar body portion includes a flathead projection, configured to function as a flathead screw driver. Alternatively, a second corner of the planar body portion includes a cruciform projection and is configured to function as a cruciform screw driver; and the cruciform projection is flat and in line with the planar body portion. Optionally, a first edge of the planar body portion includes a scraping portion, the scraping portion being a portion of the body that is angled towards the edge, resulting in a thinner, beveled edge. In another alternative, a second edge of the planar body includes a marked measuring portion, the second edge being parallel to the first edge.

DETAILED DESCRIPTION

Figure 1:
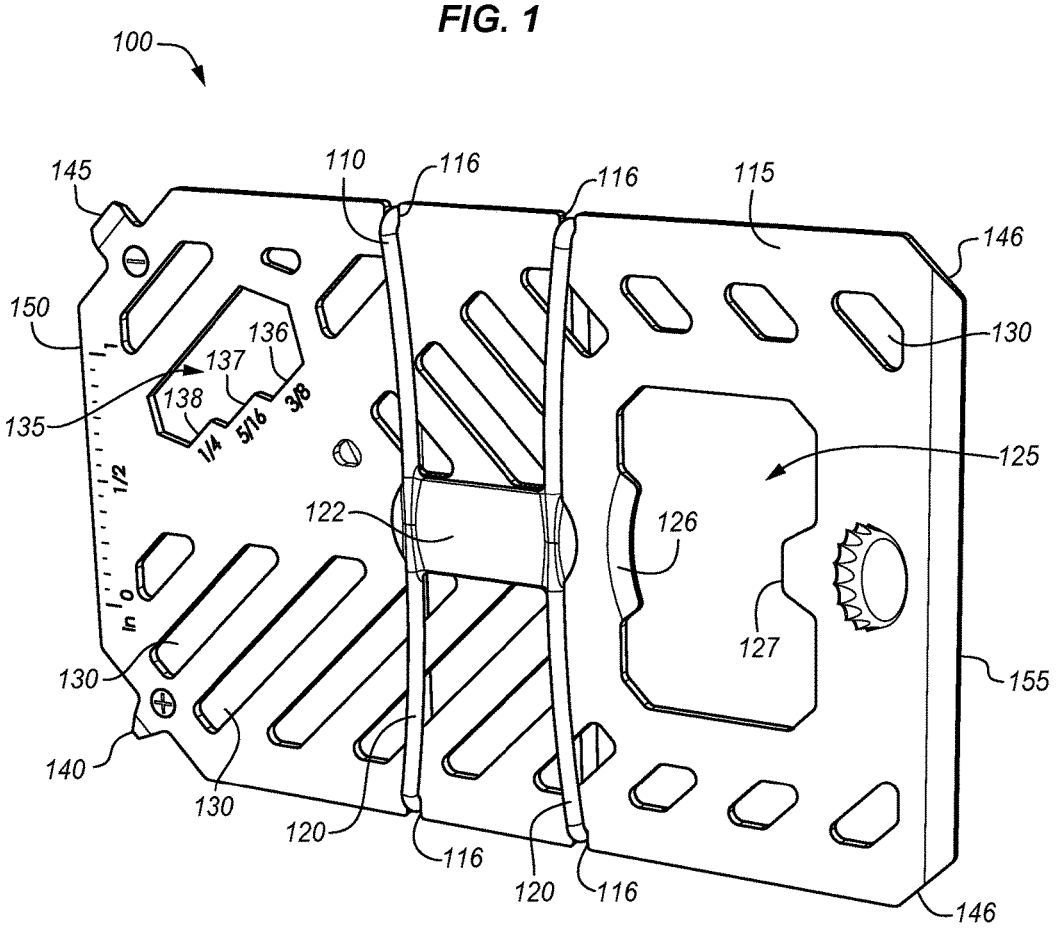
FIG. 1 shows a perspective view of one embodiment of a holder and tool device.

Certain terminology is used herein for convenience only and is not to be taken as a limitation on the embodiments of the systems and methods for a holder and tool device. In the drawings, the same reference letters are employed for designating the same elements throughout the several figures. In many embodiments, the device includes a credit card-shaped metal plate that has an elastic strap wrapped around it. The metal plate has numerous cutouts that form tools in the metal plate. The metal plate is typically aluminum. In alternatives, the plate may be plastic or composed of some other material, such as carbon fiber. To be used as a tool, the device typically needs to be strong and rigid.

FIG. 1 shows one embodiment of a holder and tool device 100. Device 100 includes a strap 110 that wraps around device 100. The strap 110 typically is composed of a rubberized material that may stretch and return to its original shape. Strap 110 is sized such that it holds taut against the metal plate 115 of device 100. Metal plate 115 may have numerous notches 116 in the side of the metal plate. These notches 116 serve to hold the strap 110 in place on the metal plate 115. As depicted, strap 110 may be composed of two narrow rings 120 connected by a bridge piece 122. This provides for a single piece strap that has wider coverage without adding significant weight and bulk to the device 100. Strap 110 is intended to hold credit cards and currency to the metal plate, to be used as a wallet or money clip.

Device 100 also includes a bottle opener section 125 in plate 115. Bottle opener section 125 includes a prying protrusion 126 and a leverage protrusion 127. The length of the plate 115 additionally provides leverage for the user. Device 100 includes numerous cutouts 130. Cutouts 130 reduce the weight of the device 100. The orientation of the cutouts is diagonal which is thought to weaken the stability of the device 100 less than cutouts 130 that are perpendicular to the sides of plate 115.

Device 100 additionally includes a wrench portion 135, which is an aperture for receiving bolt-shaped connectors. The wrench portion 135 has a stepped shape and has three portions, each having a different width, each different width corresponding to a standard nut width. As shown, the wrench portion 135 is designed to accommodate three different size wrenches 136, 137, 138, corresponding to ¼-, 5/16-, and ⅜-size bolts and nuts, which are common sizes available. In alternative embodiments, other size cutouts may be provided. In the configuration shown, the body of the device 100 functions as a lever arm, providing for additional torque when using wrench portion 135.

Device 100 additionally includes projection 140 for use as a screw driver. Projection 140 is design to interface with a cruciform receiver (an example includes a Phillips head screw). Projection 140 also can be used to score or pry objects because of its semi-sharp tip. Projection 140 is a flat projection, which is desirable, due to the usage of device 100 as a money holder. On the other corner of device 100 is another projection 145 that is used as a flat head screw driver. On the opposite end of device 100, corners 146 have been cutoff. This provides for a more ergonomic feel for device 100 when the device is used as a screw driver. Typically, corners 146 would dig into the palm of a user as they used device 100 as a screwdriver.

Figure 2:
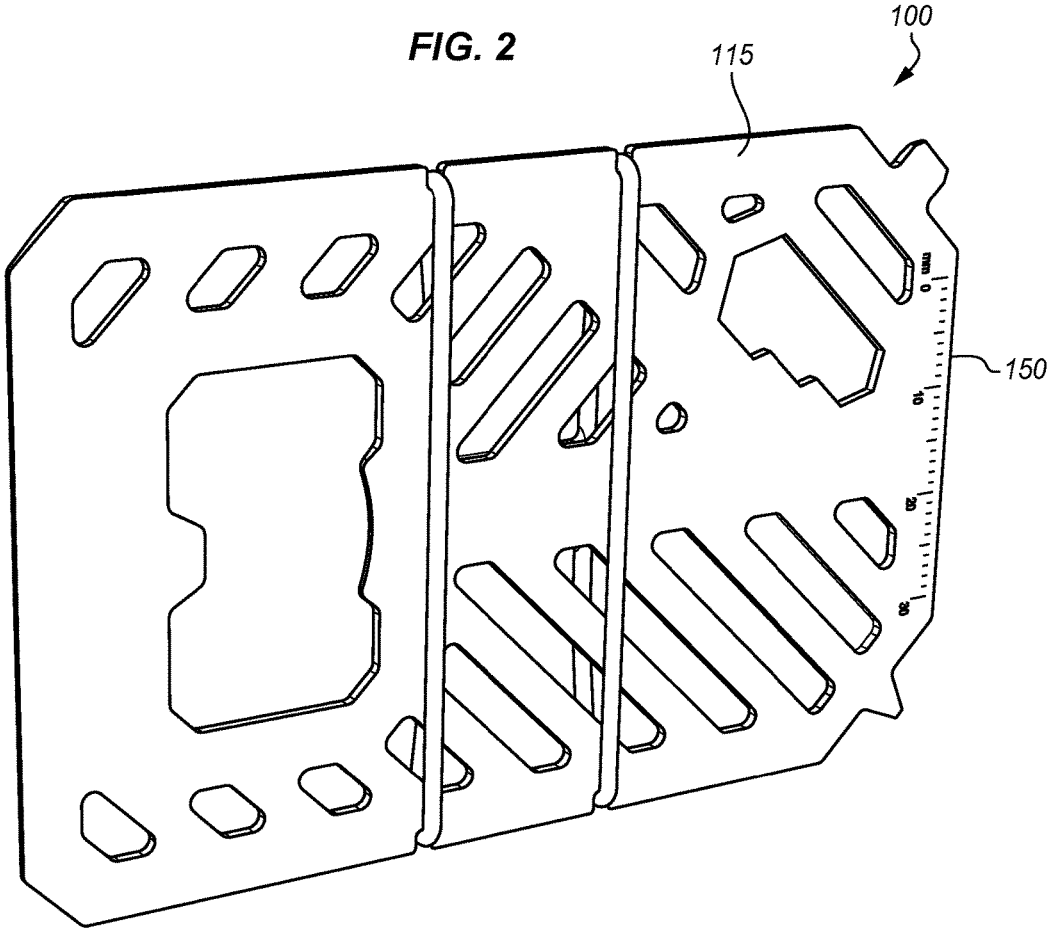
FIG. 2 shows a reverse side perspective view of the holder and tool device of FIG. 1.

Device 100 additionally includes a measuring portion 150. Measuring portion 150 includes inscribed distance markers into metal plate 115. As shown in FIG. 2, different units may be provided on the reverse side of metal plate 115.

Figure 3:
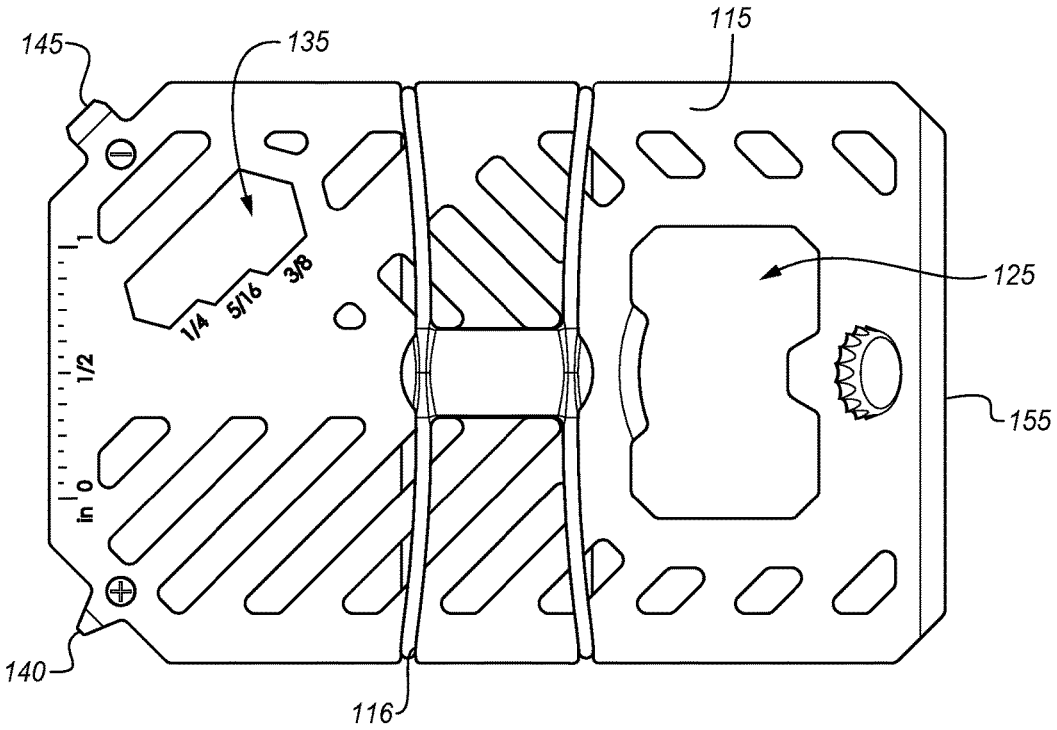
FIG. 3 shows a side view of the holder and tool device of FIG. 1.

Device 100 additionally includes a scraper portion 155. Scraper portion 155 is an angled edge that may be used in scraping various objects, such as car windshields or other items. FIG. 3 shows a side view of the device 100.

The embodiment shown provides for an arrangement of tools in the system that provides for some ergonomics and leverage considering the tools included and the necessity for the device to be card shaped.

Figure 4:
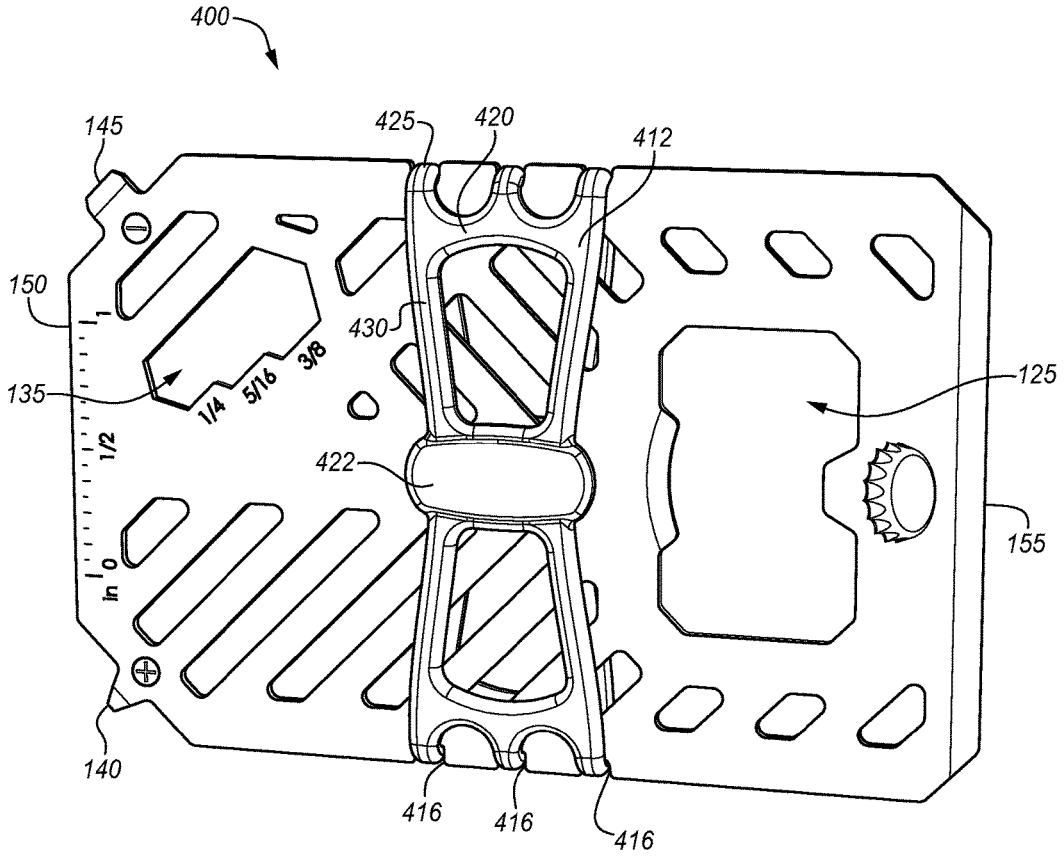
FIG. 4 shows another embodiment of a holder and tool device.

FIG. 4 shows another embodiment of a holder and tool device 400. Device 400 includes many of the same features as device 100. Device 400 include a bottle opener section 125 having a similar design to the same element in device 100. Device 400 additionally includes a wrench portion 135, which is an aperture for receiving bolt-shaped connectors. The wrench portion 135 has a stepped shape and has three portions, each having a different width, each different width corresponding to a standard nut width. Device 400 additionally includes projection 140 for use as a screw driver. Projection 140 is design to interface with a cruciform receiver (an example includes a Phillips head screw). Projection 140 also can be used to score or pry objects because of its semi-sharp tip. Projection 140 is a flat projection, which is desirable, due to the usage of device 100 as a money holder. On the other corner of device 400 is another projection 145 that is used as a flat head screw driver. Device 100 additionally includes a measuring portion 150.

The largest difference between device 100 and device 400 is the strap that holds money or credit cards to the device 400. As above, strap 412 typically is composed of a rubberized material that may stretch and return to its original shape. Strap 412 is sized such that it holds taut against the metal plate of device 400. Device 400 may have numerous notches 416 in the side of the metal plate. These notches 416 serve to hold the strap 412 in place. As depicted, the strap 412 includes a number of narrow portions 425 that interface with the notches. Strap 412 includes central portion 422 and cross portions 420 connected by elastic arms 430. This design provides strong resilience and holding, while at the same time providing for some give to the strap and providing for a reduced weigh of the strap. In many embodiments, the rear portion of strap 412 resembles the shown portion, however many alternatives are available. The design of strap 412 and similar straps is to provide for notches to hold the strap and a reduced amount of material by having arms joined by cross portions. It is thought that providing at least two notches per side provides for reduced slipping of the strap when it is inserted and taken out of a user's pocket. The central portion and cross portion are thought to prevent the stretching a single arm 430 of the strap during removal and insertion. Therefore, these features improve the function of the strap portion of the device.

While specific embodiments have been described in detail in the foregoing detailed description and illustrated in the accompanying drawings, it will be appreciated by those skilled in the art that various modifications and alternatives to those details could be developed in light of the overall teachings of the disclosure and the broad inventive concepts thereof. It is understood, therefore, that the scope of this disclosure is not limited to the particular examples and implementations disclosed herein but is intended to cover modifications within the spirit and scope thereof as defined by the appended claims and any and all equivalents thereof. Note that, although particular embodiments are shown, features of the holder and tool device may be interchanged between embodiments.

What is claimed as new and desired to be protected by Letters Patent of the United States is:

1. A tool and wallet system, comprising:

a planar body portion, the planar body portion approximately the size of a standard credit card; and a strap, the strap wrapped around the planar body portion, the strap taut to the planar body portion due to elasticity in the strap, wherein the strap is positioned in a central portion of the body and the central portion is along a longer edge of the planar body, wherein the strap comprises first, second, and third bridge pieces, a first pair of elastic arms extending between the first and second bridge pieces, a second pair of elastic arms extending between the second and third bridge pieces, and at least three elastic rings extending from each of the first and third bridge pieces and wrapping around opposing side edges of the planar body portion.

2. The system of claim 1, wherein the at least three elastic rings encircle the planar body portion.

3. The system of claim 2, wherein:

the planar body portion has a first edge and a second edge, the planar body portion being rectangular in shape and the first and second edges located on opposing sides of the planar body portion; and each of the first edge and the second edge includes a plurality of grooves, the plurality of grooves sized to receive the elastic rings and configured such that a first one of the elastic rings is located in complementary first and second grooves on the first and second edges, a second one of the elastic rings is located in complementary third and fourth grooves on the first and second edges, and a third one of the elastic rings is located in complementary fifth and sixth grooves on the first and second edges.

4. The system of claim 1, wherein the planar body portion includes a first aperture, the first aperture includes protrusions for prying open a cap on a bottle.

5. The system of claim 4, wherein the planar body portion includes a second aperture for receiving bolt-shaped connectors.

6. The system of claim 5, wherein the second aperture for receiving bolt-shaped connectors has a stepped shape, and the second aperture has three portions, each having a different width, each different width corresponding to a standard nut width.

7. The system of claim 1, wherein the planar body portion is approximately rectangular in shape, and a first corner of the planar body portion includes a flathead projection, configured to function as a flathead screw driver.

8. The system of claim 7, wherein a second corner of the planar body portion includes a cruciform projection and is configured to function as a cruciform screw driver.

9. The system of claim 7, wherein the cruciform projection is flat and in line with the planar body portion.

10. The system of claim 9, wherein a first edge of the planar body portion includes a scraping portion, the scraping portion being a portion of the body that is angled towards the edge, resulting in a thinner, beveled edge.

11. The system of claim 10, wherein a second edge of the planar body includes a marked measuring portion, the second edge being parallel to the first edge.

12. A tool and wallet system, comprising:

a planar body portion, the planar body portion approximately the size of a standard credit card, the planar body portion having an approximately rectangular shape; and a strap, the strap wrapped around the planar body portion, the strap taut to the planar body portion due to elasticity in the strap, the strap and planar body portion configured to hold paper money and credit cards, wherein the strap is positioned in a central portion of the body and the central portion is along a longer edge of the planar body, wherein the strap includes three elastic rings encircling opposing edges of the planar body portion, first and second bridge pieces each connected to the three elastic rings, and a third bridge piece connected to the first bridge piece by a first plurality of elastic arms and to the second bridge piece by a second plurality of elastic arms.

13. The system of claim 12, wherein the elastic rings encircle the planar body portion.

14. The system of claim 13, wherein:

the planar body portion has a first edge and a second edge, the planar body portion being rectangular in shape and the first and second edges located on opposing sides of the planar body portion; and each of the first edge and the second edge includes a plurality of grooves, the plurality of grooves sized to receive the elastic rings and configured such that a first one of the elastic rings is located in complementary first and second grooves on the first and second edges, a second one of the elastic rings is located in complementary third and fourth grooves on the first and second edges, and a third one of the elastic rings is located in complementary fifth and sixth grooves on the first and second edges.

15. The system of claim 14, wherein the planar body portion includes a first aperture, the first aperture includes protrusions for prying open a cap on a bottle; the planar body portion includes a second aperture for receiving bolt-shaped connectors and the second aperture for receiving bolt-shaped connectors has a stepped shape; and the second aperture has three portions, each having a different width, each different width corresponding to a standard nut width.

16. The system of claim 15, wherein the planar body portion includes numerous cutouts that reduce the weight of the planar body portion.

17. The system of claim 16, wherein a first corner of the planar body portion includes a flathead projection, configured to function as a flathead screw driver.

18. The system of claim 17, wherein a second corner of the planar body portion includes a cruciform projection and is configured to function as a cruciform screw driver, and the cruciform projection is flat and in line with the planar body portion.

19. The system of claim 18, wherein a first edge of the planar body portion includes a scraping portion, the scraping portion being a portion of the body that is angled towards the edge, resulting in a thinner, beveled edge.

20. The system of claim 19, wherein a second edge of the planar body includes a marked measuring portion, the second edge being parallel to the first edge.

21. The system of claim 1, wherein the first, second, and third bridge pieces are positioned on only one side of the planar body portion.

22. The system of claim 1, wherein the strap further comprises:

fourth, fifth, and sixth bridge pieces;

a third pair of elastic arms extending between the fourth and fifth bridge pieces; and a fourth pair of elastic arms extending between the fifth and sixth bridge pieces, wherein the at least three elastic rings extending from the first bridge piece connect to the fourth bridge piece, and wherein the at least three elastic rings extending from the third bridge piece connect to the sixth bridge piece, such that the strap is mirrored on both sides of the planar body portion.

* * * * *